US010907597B2

(12) United States Patent
Ogane

(10) Patent No.: US 10,907,597 B2
(45) Date of Patent: Feb. 2, 2021

(54) PLUNGER PUMP

(71) Applicant: KEIHIN CORPORATION, Tokyo (JP)

(72) Inventor: Yuya Ogane, Shioya-gun (JP)

(73) Assignee: KEIHIN CORPORATION, Tokyo (JP)

( * ) Notice: Subject to any disclaimer, the term of this patent is extended or adjusted under 35 U.S.C. 154(b) by 37 days.

(21) Appl. No.: 16/364,702

(22) Filed: Mar. 26, 2019

(65) Prior Publication Data

US 2019/0301413 A1 Oct. 3, 2019

(30) Foreign Application Priority Data

Mar. 28, 2018 (JP) ..... 2018-062042

(51) Int. Cl.

| | |
|---|---|
| ***F04B 9/04*** | (2006.01) |
| ***F02M 59/02*** | (2006.01) |
| ***F04B 1/143*** | (2020.01) |
| ***F04B 1/122*** | (2020.01) |

(52) U.S. Cl.

CPC ..... *F02M 59/02* (2013.01); *F04B 1/122* (2013.01); *F04B 1/143* (2013.01)

(58) Field of Classification Search

CPC ..... F04B 7/0266; F04B 9/042; F04B 9/045; F04B 11/00; F04B 11/0091; F04B 53/007; F04B 53/008; F04B 53/162; F04B 53/14; F04B 53/16; F02M 59/02; F02M 59/442; F02M 59/44; F02M 59/368; F02M 2200/04; F02M 55/04

See application file for complete search history.

(56) References Cited

U.S. PATENT DOCUMENTS 4,399,997 A * 8/1983 Broken ..... F04B 53/162 277/422
4,705,459 A * 11/1987 Buisine ..... F04B 51/00 417/53
4,968,220 A * 11/1990 Filippi ..... F04B 1/053 417/273
7,186,097 B1 * 3/2007 Blume ..... F04B 53/007 417/454

(Continued)

FOREIGN PATENT DOCUMENTS

JP 2009108784 A 5/2009

*Primary Examiner* — Charles G Freay
*Assistant Examiner* — Thomas Fink
(74) *Attorney, Agent, or Firm* — Cantor Colburn LLP

(57) ABSTRACT

This plunger pump includes a pressurization chamber that has a tubular inner circumferential wall and a plunger that has a substantially cylindrical outer circumferential surface. The inner circumferential wall has, in a part thereof in a circumferential direction about an axis of the plunger, a suction opening, which communicates with the pressurization chamber and is for introducing a fuel into the pressurization chamber. The inner circumferential wall is formed with an enlarged gap portion having a larger dimension than a dimension, at a position of the suction opening, from the outer circumferential surface of the plunger to an inner circumferential surface of the inner circumferential wall along a radial direction of the plunger, in at least a part of the inner circumferential wall at a position away from the position of the suction opening in the circumferential direction.

1 Claim, 4 Drawing Sheets

(56) References Cited

U.S. PATENT DOCUMENTS

| | | | | |
|---|---|---|---|---|
| 8,366,402 | B2 * | 2/2013 | St. Michel | F04B 49/22<br>417/63 |
| 9,377,019 | B1 * | 6/2016 | Blume | F04B 53/16 |
| 2017/0016431 | A1 * | 1/2017 | Ivantysynova | F01B 3/0044 |
| 2017/0082103 | A1 * | 3/2017 | Morreale | F04B 19/22 |

* cited by examiner

PLUNGER PUMP

CROSS REFERENCE TO RELATED APPLICATION

The present application claims priority under 35 U.S.C. § 119 to Japanese Application No. 2018-062042, filed Mar. 28, 2018, the entire content of which is incorporated herein by reference.

BACKGROUND OF THE INVENTION

Field of the Invention

The present invention relates to a plunger pump.

Description of Related Art

For example, a high-pressure fuel supply pump that pressurizes internal fuel by reciprocating a plunger inserted in a cylinder toward a pressurization chamber is disclosed in Japanese Unexamined Patent Application, First Publication No. 2009-108784.

A gap is formed between such a plunger and an inner wall surface of the pressurization chamber, and is filled with fuel. Since the fuel is pressurized at a high pressure of 20 MPa or higher in such a plunger pump, even a liquid fuel is compressed in a small amount. The pressurization of the fuel is carried out by the plunger reducing the volume of the pressurization chamber. For this reason, when a maximum volume of the pressurization chamber is equal to a volume of the pressurization chamber which is reduced by the plunger, a discharge amount from the pressurization chamber is maximum and volumetric efficiency is maximum, considering that fuel is compressed. It is required to make a dead volume represented by the gap small in order to improve the volumetric efficiency.

As the plunger reciprocating in an inner circumferential wall, shear stress along a plunger axis direction occurs inside the fuel filled in the gap. At this time, in the above-mentioned plunger pump having the small gap, since the flow velocity of the fuel suddenly changes from the inner wall surface of the pressurization chamber to a circumferential surface of the plunger, shear stress also becomes great and the pressure of the fuel suddenly decreases. Consequently, the pressure of the fuel in the gap locally becomes a pressure that is equal to or lower than a saturated vapor pressure, and thus there is a possibility that cavitation occurs. Cavitation results in erosion, and can have an adverse effect on the durability of the pump.

In view of the problems described above, an object of the present invention is to suppress cavitation in a circumferential surface of a plunger in a plunger pump.

SUMMARY OF THE INVENTION

In order to achieve the object, the present invention adopts the following aspects.

(1) According to an aspect of the present invention, there is provided a plunger pump including: a pressurization chamber that has a tubular inner circumferential wall; and a plunger that has a substantially cylindrical outer circumferential surface and is held by a guide portion so as to freely slide along an extending direction of the inner circumferential wall, wherein the inner circumferential wall has, in a part thereof in a circumferential direction about an axis of the plunger, a suction opening, which communicates with the pressurization chamber and is for introducing a fuel into the pressurization chamber, and wherein the inner circumferential wall is formed with an enlarged gap portion having a larger dimension than a dimension, at a position of the suction opening, from the outer circumferential surface of the plunger to an inner circumferential surface of the inner circumferential wall along a radial direction of the plunger, in at least a part of the inner circumferential wall at a position away from the position of the suction opening in the circumferential direction.

(2) In the aspect of (1), the following configurations may be adopted. The inner circumferential wall has, at a position which opposes the position where the suction opening is formed with the plunger interposed therebetween, a discharge opening for discharging the fuel from the pressurization chamber. A sectional shape of the pressurization chamber, which is orthogonal to the axis of the plunger, is an elliptical shape. The suction opening and the discharge opening are provided in the inner circumferential wall on a minor axis side. An interval between the inner circumferential wall on a major axis side of the elliptical shape and the outer circumferential surface of the plunger is the enlarged gap portion.

(3) In the aspect of (2), the plunger may be disposed such that the axis of the plunger is eccentric to a center of the pressurization chamber toward a suction opening side.

(4) In the aspect of (1), the following configurations may be adopted. A sectional shape of the inner circumferential wall, which is orthogonal to the axis of the plunger, is a circular shape. The axis of the plunger is disposed to be eccentric to a center of the circular shape toward a suction opening side.

(5) In the aspect of (1), the enlarged gap portion may be a recessed portion formed in the inner circumferential wall.

(6) In the aspect of (5), the following configurations may be adopted. A discharge opening for discharging the fuel from the pressurization chamber is provided in the inner circumferential wall. The recessed portion is provided between the suction opening and the discharge opening in the circumferential direction.

(7) In the aspect of (6), the recessed portion may be provided in a region closer to the discharge opening in the circumferential direction than to the suction opening.

(8) In the aspect of (6), the following configurations may be adopted. The suction opening and the discharge opening are provided at positions that do not oppose each other with the axis of the plunger interposed therebetween. The recessed portion is formed in the inner circumferential surface of the inner circumferential wall, and is provided at a position that opposes the suction opening or the discharge opening in the circumferential direction with the axis of the plunger interposed therebetween.

(9) In the aspect of (7), the following configurations may be adopted. The suction opening and the discharge opening are provided at positions that do not oppose each other with the axis of the plunger interposed therebetween. The recessed portion is formed in the inner circumferential surface of the inner circumferential wall, and is provided at a position that opposes the suction opening or the discharge opening in the circumferential direction with the axis of the plunger interposed therebetween.

According to each of the aspects of the present invention, the enlarged gap portion is formed in the inner circumferential wall. Therefore, the flow velocity shift in the fuel existing in the gap between the inner circumferential wall and the plunger is suppressed to be small, and it can be suppressed that the pressure of the fuel becomes equal to or lower than a saturated vapor pressure. Therefore, it is possible to suppress cavitation in the circumferential surface of the plunger in the plunger pump.

DETAILED DESCRIPTION OF THE INVENTION

Hereinafter, embodiments of a plunger pump according to the present invention will be described with reference to the drawings. In order to make each member be in a recognizable size, the scale of each member is modified as appropriate in the following drawings.

First Embodiment

Figure 1:
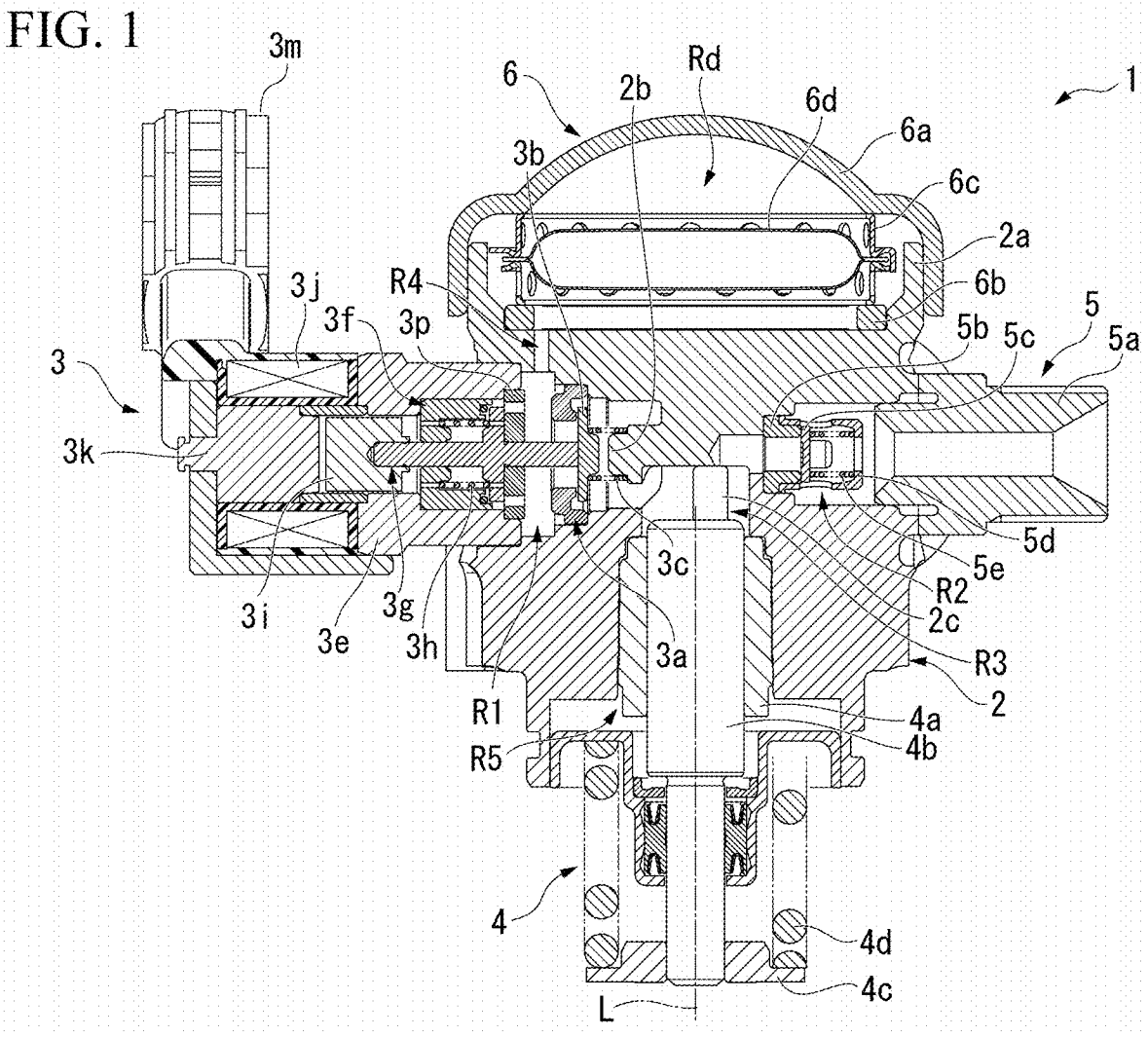
FIG. 1 is a sectional view illustrating a schematic configuration of a plunger pump of a first embodiment of the present invention.

FIG. 1 is a sectional view illustrating a schematic configuration of a plunger pump 1 of the embodiment. As illustrated in FIG. 1, the plunger pump 1 of the embodiment includes a body 2, a suction mechanism 3, a pressure increasing mechanism 4, a discharging mechanism 5, and a damper mechanism 6. In the following description, an axis of a plunger that increases the pressure of fuel will be referred to as a central axis L, a direction orthogonal to the central axis L will be referred to as a radial direction, a side approaching the central axis L in the radial direction will be referred to as a radially inner side, and a side separating away from the central axis L in the radial direction will be referred to as a radially outer side. In addition, although a position in which the plunger pump 1 is mounted is not limited, an upper side of the page in FIG. 1 will be referred to as an upward direction, and a lower side of the page in FIG. 1 will be referred to as a downward direction, for convenience of description.

The body 2 is a base part where the suction mechanism 3, the pressure increasing mechanism 4, the discharging mechanism 5, and the damper mechanism 6 are attached, and fuel passages that guide fuel are formed therein. As illustrated in FIG. 1, a suction flow passage R1 into which a part of the suction mechanism 3 is fitted and a discharge flow passage R2 into which a part of the discharging mechanism 5 is fitted are formed as fuel passages inside the body 2 in the plunger pump 1 of the embodiment. In addition, a pressurization chamber R3, which connects the suction flow passage R1 to the discharge flow passage R2 and in which pressurization of fuel is performed, is provided inside the body 2. The pressurization chamber R3 is disposed in a middle portion of the body 2 in the radial direction.

In addition, a cylindrical surrounding wall portion 2*a* protruding from a top surface toward the upward direction is provided in an upper portion of the body 2. The surrounding wall portion 2*a* forms a part of a damper chamber Rd to be described later. In addition, a supply flow passage R4 (fuel passage) that passes from a bottom portion of the damper chamber Rd (that is, the top surface of the body 2) to the suction flow passage R1 is formed inside the body 2. In addition, although not illustrated in FIG. 1, the body 2 also has another fuel passage such as a flow passage through which fuel is supplied from the outside of the damper chamber Rd to the damper chamber Rd.

In addition, the body 2 has a cylindrical through space R5 that penetrates from the pressurization chamber R3 in the downward direction and accommodates a pressure increasing plunger 4*b* (to be described later) so as to be movable, the pressure increasing plunger 4*b* having a cylindrical shape. An inner circumferential surface of the present embodiment is formed by a wall surface that configures the pressurization chamber R3 and surrounds the central axis L. In addition, the body 2 has a spring holding portion 2*b* that extends toward the suction flow passage R1 and is disposed so as to oppose a suction valve body 3*b* to be described later from a downstream side in a fuel flowing direction (the radially inner side). A suction spring 3*c* which biases the suction valve body 3*b* and is to be described later, is attached to the spring holding portion 2*b*. The spring holding portion 2*b* also functions as a stopper that regulates the movement of the suction valve body 3*b* from the downstream side in the fuel flowing direction (the radially inner side).

FIG. 3A to FIG. 3E are views of sections perpendicular to the central axis L of the pressure increasing plunger 4*b* of the plunger pump 1 according to the present embodiment, which include the body 2, the suction mechanism 3, and the discharging mechanism 5.

Figure 3A:
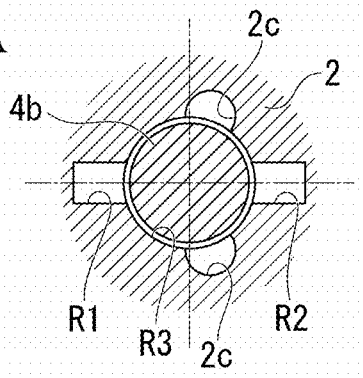
FIG. 3A is a view of a section perpendicular to a pressure increasing plunger of the plunger pump, which includes a body, the suction mechanism, and a discharging mechanism.

As illustrated in FIG. 3A, two recessed portions 2*c* (enlarged gap portions) are formed in the inner circumferential surface of the pressurization chamber R3. These recessed portions 2*c* are provided at positions which are separated away from the suction mechanism 3 and the discharging mechanism 5 in a circumferential direction of the pressure increasing plunger 4*b* to be described later and at which cavitation is most likely to occur. The recessed portions 2*c* are disposed so as to oppose each other with a plane passing through the center of the suction mechanism 3, including the central axis L of the pressure increasing plunger 4*b*, interposed therebetween. Each of the recessed portions 2*c* has a curved surface such that a shape of a section perpendicular to the central axis L of the pressure increasing plunger 4*b* is an arc shape. Each of the recessed portions 2*c* is formed to be connected to at least a part of a pressurization chamber R3 side end portion of the pressure increasing plunger 4*b* from a top dead center to a bottom dead center and to be exposed to the pressurization chamber R3.

Figure 2:
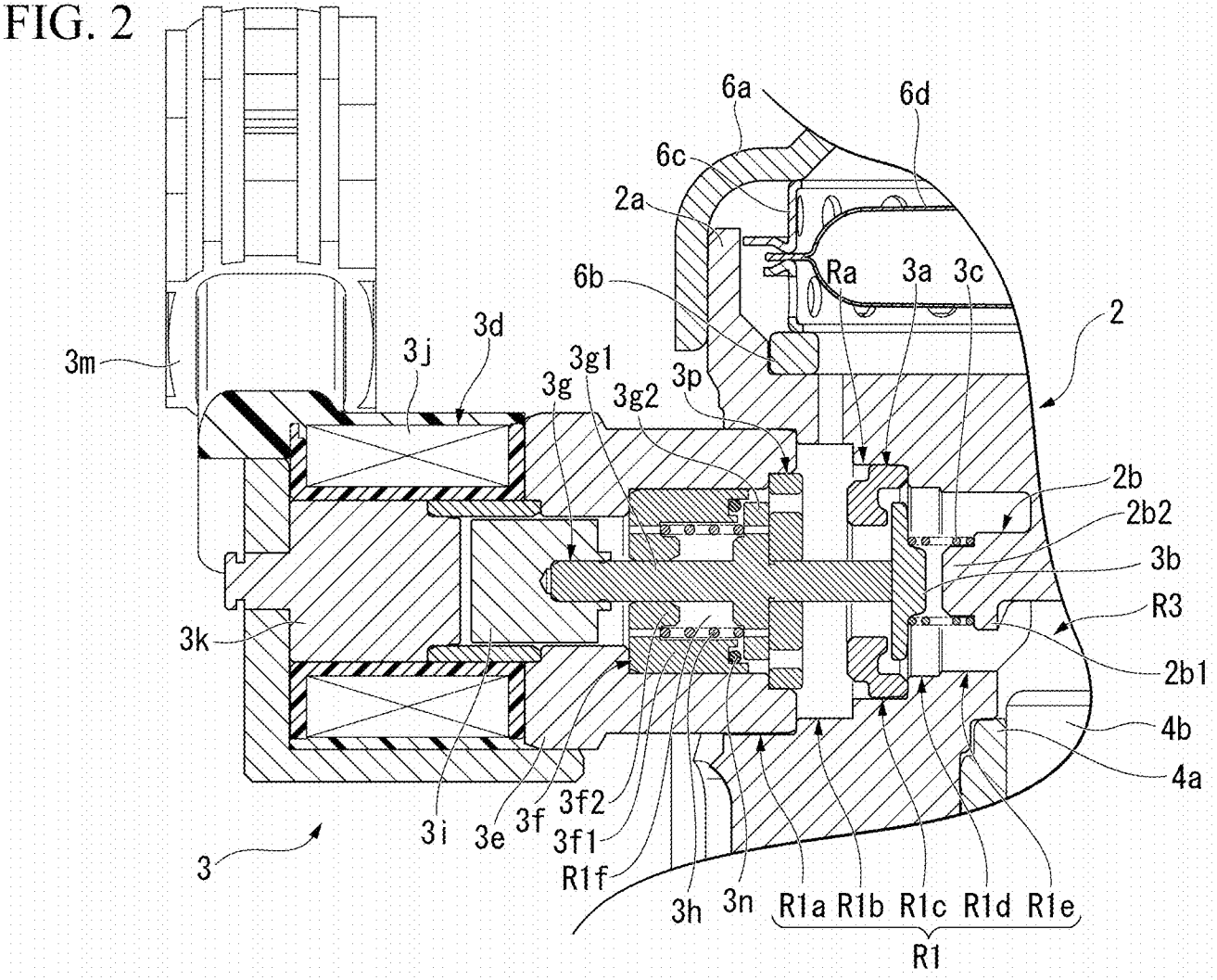
FIG. 2 is an enlarged sectional view including a part of a suction mechanism included in the plunger pump.

As illustrated in FIG. 2, the suction mechanism 3 includes a valve seat 3*a*, the suction valve body 3*b*, the suction spring 3*c*, and a solenoid unit 3*d*. The valve seat 3*a* is disposed in the suction flow passage R1, and has an opening that is opened and closed by the suction valve body 3*b*. The suction valve body 3*b* is disposed on an inner side of the valve seat 3*a* in a radial direction of the body, and is held by the suction spring 3*c* so as to be movable in the radial direction of the body. The suction spring 3*c* is held by an end portion thereof on the inner side in the radial direction of the body being fitted onto the spring holding portion 2*b* of the body 2. An end portion of the suction spring 3*c* on an outer side in the radial direction of the body is fitted onto a protrusion provided on a middle portion of the suction valve body 3*b*. The suction spring 3*c* is a compression coil spring which can be compressed by a differential pressure in a case where a pressure on an upstream side of the suction valve body 3*b* is relatively higher than a pressure on the downstream side, and biases the suction valve body 3*b* toward the outer side in the radial direction of the body.

The solenoid unit 3*d* includes a base portion 3*e*, a guide member 3*f* (stopper), a suction plunger 3*g* (linear motion component), a suction spring 3*h*, a movable core 3*i*, a coil 3*j*, a fixed core 3*k*, a connector 3*m*, and an elastic body 3*n*. The base portion 3*e* is fixed to the body 2. The base portion 3*e* directly or indirectly supports the guide member 3*f*, the suction plunger 3*g*, the suction spring 3*h*, the movable core 3*i*, the coil 3*j*, the fixed core 3*k*, and the connector 3*m*. The base portion 3*e* has a substantially cylindrical shape having a through-hole in a middle portion thereof. A tip portion of the base portion 3*e* is inserted in the suction flow passage R1 of the body 2 from the outer side in the radial direction of the body.

The guide member 3*f* is a substantially cylindrical component disposed coaxially with the base portion 3*e*, and is fitted in the through-hole provided in the base portion 3*e*. The guide member 3*f* has an inner circumferential wall 3*f*1 having a through-hole into which the suction plunger 3*g* is inserted so as to be movable in the radial direction, and a guide flange 3*f*2 which is provided to protrude from an outer circumferential surface of the inner circumferential wall 3*f*1 and is fixed to the base portion 3*e*.

The suction plunger 3*g* has a shank 3*g*1 and a plunger flange 3*g*2. The shank 3*g*1 is a bar-shaped part which is movably inserted in the through-hole of the inner circumferential wall 3*f*1 of the guide member 3*f* and is longer than the guide member 3*f* along the radial direction. The shank 3*g*1 has a radially inner end portion positioned at the position more on the radially inner side than the guide member 3*f*, and a radially outer end portion positioned at the position more on the radially outer side of the guide member 3*f*. The plunger flange 3*g*2 is a plate-shaped part provided to protrude from an outer circumferential surface of the shank 3*g*1, and is disposed at a position on the radially inner side of the guide member 3*f*. Such a suction plunger 3*g* is movable in the radial direction between a radially inner end surface of the guide member 3*f* and a radially outer end surface of the valve seat 3*a*. In addition, in a case where the plunger flange 3*g*2 abuts against a flange stopper 3*p* from the radially outer side, the movement of the suction plunger 3*g* to the radially inner side is regulated. In a case where the plunger flange 3*g*2 abuts against the guide member 3*f* from the radially inner side, the movement of the suction plunger to the radially outer side is regulated. In addition, in a case where the plunger flange 3*g*2 of the suction plunger 3*g* abuts against the flange stopper 3*p*, a radially inner end surface of the shank 3*g*1 can abut against the suction valve body 3*b*.

The suction spring 3*h* is a compression coil spring fitted onto the inner circumferential wall 3*f*1 of the guide member 3*f*. The suction spring 3*h* has a radially inner end surface abutting against the guide flange 3*f*2 of the guide member 3*f*, and a radially outer end surface abutting against the plunger flange 3*g*2 of the suction plunger 3*g*. The suction spring 3*h* biases the suction plunger 3*g* to the radially inner side. In a case of not being electrically connected to the coil 3*j*, the suction spring 3*h* biases the suction plunger 3*g* to the radially inner side such that the suction valve body 3*b* is in an open position.

The movable core 3*i* is fixed to the radially outer end portion of the shank 3*g*1 of the suction plunger 3*g*. The movable core 3*i* is accommodated inside the through-hole of the base portion 3*e*, and is movable in the radial direction. The movable core 3*i* is moved to the radially outer side by a magnetic field which is generated by being electrically connected to the coil 3*j*. The movable core 3*i* moves to the radially inner side due to the resilience of the suction spring 3*h* when electrical connection to the coil 3*j* is stopped. The coil 3*j* has a substantially cylindrical shape around which winding is wound with substantially the same radius as the base portion 3*e*, and is connected to a radially outer end portion of the base portion 3*e*. The coil 3*j* generates a magnetic field by being electrically connected to the outside via the connector 3*m*. The fixed core 3*k* is provided inside the coil 3*j* so as to close an opening provided in the middle of the coil 3*j* from the radially outer side. The connector 3*m* is supported by the fixed core 3*k*, and is electrically connected to the coil 3*j*. The connector 3*m* is connected to a power supply device (for example, a vehicle battery) mounted outside the plunger pump 1 of the embodiment.

Referring back to FIG. 1, the pressure increasing mechanism 4 includes a barrel 4*a*, the pressure increasing plunger 4*b*, a lower flange 4*c*, and a pressure increasing spring 4*d*. The barrel 4*a* is a tubular component that is fitted in the through space R5 of the body 2 and supports the pressure increasing plunger 4*b* so as to be able to rise and fall. The pressure increasing plunger 4*b* is held so as to be able to rise and fall such that an upper end surface thereof faces the pressurization chamber R3 of the body 2. The pressure increasing plunger 4*b* has a lower end surface thereof abutting against a cam (not illustrated), and rises and falls according to the rotation of the cam when the cam is rotated by the driving of an engine mounted in a vehicle. The lower flange 4*c* is connected to a lower end portion of the pressure increasing plunger 4*b*, and protrudes from a circumferential surface of the pressure increasing plunger 4*b* to the radially outer side. The pressure increasing spring 4*d* is a compression coil spring inserted between the body 2 and the lower flange 4*c*, and biases the pressure increasing plunger 4*b* toward the downward direction via the lower flange 4*c*. Such a pressure increasing mechanism 4 increases the pressure of fuel in the pressurization chamber R3 by the pressure increasing plunger 4*b* rising and reducing the volume of the pressurization chamber R3.

The discharging mechanism 5 is disposed at a position which opposes the suction mechanism 3 with the pressure increasing plunger 4*b* interposed therebetween. The discharging mechanism 5 includes a discharge nozzle 5*a*, a discharge valve seat 5*b*, a discharge valve body 5*c*, a spring holding portion 5*d*, and a discharge spring 5*e*. The discharge nozzle 5*a* is a substantially cylindrical component fixed to the body 2 so as to be connected to the discharge flow passage R2, and discharges fuel, of which a pressure is increased by the plunger pump 1 of the embodiment, to the outside.

The discharge valve seat 5*b* is in the inside of the discharge flow passage R2 and is disposed nearest to the pressurization chamber R3 (nearest to the radially inner side), among configuration components of the discharging mechanism 5. The discharge valve seat 5*b* has an opening that is opened and closed by the discharge valve body 5*c*. The discharge valve body 5*c* is disposed on the radially outer side of the discharge valve seat 5*b*, and is held by the discharge spring 5*e* so as to be movable in the radial direction. The spring holding portion 5*d* is fitted onto the discharge valve seat 5*b* such that the discharge valve body 5*c* is surrounded, and accommodates the discharge valve body 5*c* and the discharge spring 5*e* therein. The spring holding portion 5*d* has a substantially cylindrical shape having a through-hole provided in a circumferential surface, a bottom surface, or the like, and allows fuel to pass therethrough from the inside to the outside. The discharge spring 5*e* is a compression coil spring inserted between an inner circumferential surface of the spring holding portion 5*d* and the discharge valve body 5*c*, and biases the discharge valve body 5*c* toward the radially inner side (discharge valve seat 5*b* side).

The damper mechanism 6 includes a cover 6*a*, a seat spring 6*b*, a retainer 6*c*, and a pulsation damper 6*d*. The cover 6*a* is set to have a domed shape, and is fixed to the surrounding wall portion 2*a* of the body 2 so as to form the damper chamber Rd with the body 2. The seat spring 6*b* is placed on the bottom portion of the damper chamber Rd (that is, the top surface of the body 2). The seat spring 6*b* is disposed below the retainer 6*c*, and biases the retainer 6*c* toward an inner circumferential surface of the cover 6*a*. The retainer 6*c* is a substantially ring-shaped member that holds the pulsation damper 6*d*, and a plurality of through-holes are formed in a circumferential surface thereof. The pulsation damper 6*d* is a member obtained by bonding two diaphragms in an up-and-down direction such that an internal space is formed, and is accommodated in a region surrounded by the retainer 6*c*. The pulsation damper 6*d* compresses or expands according to the pressure of the damper chamber Rd, and absorbs fluctuations in the pressure of the damper chamber Rd.

In the plunger pump 1 of the embodiment having such a configuration, the pressure increasing plunger 4*b* falls, and electrical connection to the coil 3*j* of the suction mechanism 3 is stopped (or a current value for electrical connection is decreased) in accordance with a timing when the pressure of the pressurization chamber R3 decreases. Accordingly, the suction plunger 3*g* moves to the radially inner side due to the resilience of the suction spring 3*h*, and a gap is formed between the valve seat 3*a* and the suction valve body 3*b*. When the gap is formed between the valve seat 3*a* and the suction valve body 3*b*, fuel stored in the damper chamber Rd is supplied to the pressurization chamber R3 through the supply flow passage R4 and the suction flow passage R1. The suction plunger 3*g* is pulled backed to the radially outer side in an extremely short time due to the electrical connection to the coil 3*j*; however, the suction valve body 3*b* maintains an opened state due to the pressure of fuel flowing in the gap between the valve seat 3*a* and the suction valve body 3*b* until the pressurization chamber R3 is filled with fuel and a pressure increase starts.

At an early stage of a suction stroke, as the pressure increasing plunger 4*b* falls, the pressure of the pressurization chamber R3 decreases, and the pressure of fuel flowed in the pressurization chamber R3 decreases. Then, some fuel of which a pressure has increased in a pressure increasing stroke remains in the recessed portions 2*c*.

In the suction stroke, a sudden pressure decrease is unlikely to occur in the vicinity of the suction flow passage R1 and the discharge flow passage R2 since a space where fuel exists extends around the pressure increasing plunger 4*b*. Even if a pressure decrease has occurred in the vicinity of the suction flow passage R1, the fuel is likely to be supplied to a place where the pressure has decreased since the fuel, which passes through the suction flow passage R1 and flows into the pressurization chamber R3, abundantly circulates, and a more sudden pressure decrease is unlikely to occur compared to the vicinity of the discharge flow passage R2. On the contrary, cavitation attributable to a sudden pressure decrease of fuel is likely to occur at a position separated away from the suction mechanism 3 and the discharging mechanism 5 in the circumferential direction since a gap between an inner circumferential surface of the through space R5 and the pressure increasing plunger 4*b* is small. Since fuel exists in the recessed portions 2*c* in the embodiment, the flow velocity shift in the fuel existing in a gap between a radially outer surface of each of the recessed portions 2*c* and the pressure increasing plunger 4*b* is suppressed to be small, and it can be suppressed that fuel has a pressure which is equal to or lower than a saturated vapor pressure. In addition, as described above, the recessed portions 2*c* are formed to be connected to at least a part of the pressurization chamber R3 side end portion of the pressure increasing plunger 4*b* from the top dead center to the bottom dead center and to be exposed to the pressurization chamber R3. For this reason, as the pressure increasing plunger 4*b* falls, the recessed portions 2*c* become more exposed to the pressurization chamber R3. Fuel flowed in the pressurization chamber R3 passes through the inside of the gap between the radially outer surface of each of the recessed portions 2*c* and the pressure increasing plunger 4*b*, and is likely to flow in the circumferential direction into a gap where a pressure between the pressure increasing plunger 4*b* and the inner circumferential surface is likely to decrease. Therefore, it is possible to suppress cavitation in the circumferential surface of the pressure increasing plunger 4*b* in the plunger pump.

The volume of the pressurization chamber R3 is reduced as the pressure increasing plunger 4*b* rises, and the pressure of fuel in the pressurization chamber R3 is increased. When the pressure of the fuel is increased, the suction valve body 3*b* is pushed back to the radially outer side, and the suction valve body 3*b* comes into a closed state. Until the suction valve body 3*b* completely comes into a closed state, some fuel of which the pressure has increased flows back to the damper chamber Rd through the suction flow passage R1 and the supply flow passage R4. At this time, the pulsation damper 6*d* is compressed, and accordingly pressure fluctuations in the damper chamber Rd are absorbed.

When the pressure of the fuel is increased in the pressurization chamber R3, the discharge valve body 5*c* of the discharging mechanism 5 is pressed to the radially outer side, and a gap is formed between the discharge valve body 5*c* and the discharge valve seat 5*b*. As a result, the fuel, of which the pressure is increased in the pressurization chamber R3, is discharged to the outside of the plunger pump 1 of the embodiment through the discharge flow passage R2 and the discharge nozzle 5*a*.

In the plunger pump 1 according to the embodiment, the flow velocity shift in fuel remaining in the recessed portions 2*c* formed in the inner circumferential surface of the through space R5, that is, fuel existing in the gap between the radially outer surface of each of the recessed portion 2*c* and the pressure increasing plunger 4*b* is suppressed to be small.

Consequently, fuel is prevented from undergoing a pressure decrease to a point of having a pressure equal to or lower than the saturated vapor pressure, and fuel cavitation can be suppressed.

Since the recessed portions 2*c* are local cavities, an increase in a dead volume can be suppressed to be the minimum.

In addition, the recessed portions 2*c* are formed at positions which are separated away from the suction mechanism 3 and the discharging mechanism 5 in the circumferential direction and at which cavitation is most likely to occur, and thus fuel cavitation can be more effectively suppressed.

In addition, in a section perpendicular to a central axis L direction of the pressure increasing plunger 4*b*, the shape of a bottom portion of each of the recessed portions 2*c* is an arc shape. Consequently, when fuel has flowed in the recessed portions 2*c*, the fuel is likely to flow out from the inside of the recessed portions 2*c* toward the circumferential direction. Therefore, fuel cavitation in the inner circumferential surface of the through space R5 can be effectively suppressed.

Second Embodiment

A modification example of the plunger pump 1 according to the first embodiment will be described as a second embodiment. The same mechanism elements will be assigned with the same references, and description thereof will be omitted.

Figure 3B:
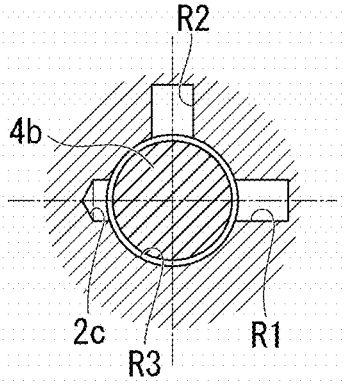
FIG. 3B is a view illustrating a second embodiment of the present invention, and is a view of a section perpendicular to a pressure increasing plunger of a plunger pump, which includes a body, a suction mechanism, and a discharging mechanism.

As illustrated in FIG. 3B, in the plunger pump 1 according to the embodiment, the suction flow passage R1 and the discharge flow passage R2 are provided to form an angle with the pressure increasing plunger 4*b* as a center. That is, the suction flow passage R1 does not oppose the discharge flow passage R2 in the circumferential direction of the pressure increasing plunger 4*b* with the pressure increasing plunger 4*b* interposed therebetween, and opposes the recessed portion 2*c* with the pressure increasing plunger 4*b* interposed therebetween. The recessed portion 2*c* has a substantially triangular pyramid shape, and a bottom portion thereof has a mortar shape.

In such a plunger pump 1 according to the embodiment, the recessed portion 2*c* is formed in the inner circumferential surface of the through space R5, which opposes the suction mechanism 3. Consequently, it is possible to perform processing to form the recessed portion 2*c* from an opening formed in the body 2 in order to attach the suction mechanism 3, and it is easy to form the recessed portion 2*c*.

Third Embodiment

A modification example of the plunger pump 1 according to the first embodiment will be described as a third embodiment. The same mechanisms will be assigned with the same references, and description thereof will be omitted.

Figure 3C:
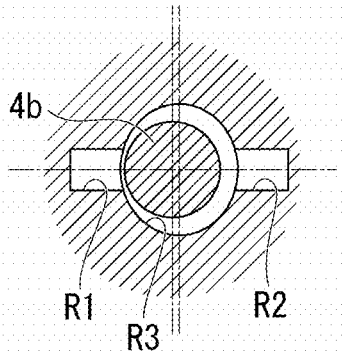
FIG. 3C is a view illustrating a third embodiment of the present invention, and is a view of a section perpendicular to a pressure increasing plunger of a plunger pump, which includes a body, a suction mechanism, and a discharging mechanism.

As illustrated in FIG. 3C, in the plunger pump 1 according to the embodiment, the pressurization chamber R3 has an elliptical shape in a section orthogonal to the central axis L of the pressure increasing plunger 4*b*. In addition, the suction flow passage R1 and the discharge flow passage R2 are provided to oppose each other on a minor axis side of the elliptical shape with the central axis L interposed therebetween. The pressure increasing plunger 4*b* inserted in the through space R5 is provided at a position where the central axis L is eccentric to the center of the pressurization chamber R3 toward a suction flow passage R1 side. Consequently, a gap (enlarged gap portion) wider than other gaps is formed between an inner circumferential surface of the pressurization chamber R3 and the pressure increasing plunger 4*b* in a region of the inner circumferential wall between the suction flow passage R1 and the discharge flow passage R2 (inner circumferential wall of the elliptical shape on a major axis side).

The plunger pump 1 according to the embodiment is set such that the gap becomes wider as being more separated away from an opening end of the suction flow passage R1 (suction opening). Consequently, a sudden pressure decrease of fuel can be suppressed in a region, which is separated away from the suction opening in a circumferential direction of the plunger and in which a sudden pressure decrease of fuel is most likely to occur, and thus the occurrence of cavitation can be effectively suppressed. Cavitation can be more effectively suppressed by setting a wide gap on a discharge opening side where cavitation is more likely to occur than the suction opening side.

In addition, a wide gap (enlarged gap portion) can be formed between the pressurization chamber R3 and the pressure increasing plunger 4*b* instead of providing the recessed portion 2*c*, and thus processing is easy compared to a case where the recessed portion 2*c* is formed in the inner circumferential surface of the pressurization chamber R3.

Fourth Embodiment

A modification example of the plunger pump 1 according to the first embodiment will be described as a fourth embodiment. The same mechanisms will be assigned with the same references, and description thereof will be omitted.

Figure 3D:
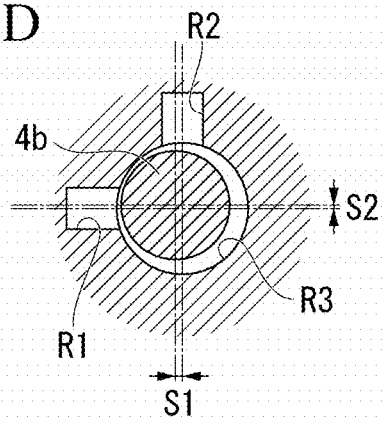
FIG. 3D is a view illustrating a fourth embodiment of the present invention, and is a view of a section perpendicular to a pressure increasing plunger of a plunger pump, which includes a body, a suction mechanism, and a discharging mechanism.

As illustrated in FIG. 3D, the plunger pump 1 according to the embodiment is formed such that the suction flow passage R1 and the discharge flow passage R2 form a right angle with the pressure increasing plunger 4*b* interposed therebetween. The pressurization chamber R3 and the pressure increasing plunger 4*b* each have a sectional shape that is a circle, and are disposed in a state where the center of the pressure increasing plunger 4*b* is eccentric to the center of the pressurization chamber R3 toward the suction flow passage R1 side by a distance of an eccentric width S1 and is eccentric to the center of the pressurization chamber toward a discharge flow passage R2 side by a distance of an eccentric width S2. The eccentric width S2 is set to be smaller than the eccentric width S1. Consequently, the enlarged gap portion is set such that a gap between the opening end (suction opening) of the suction flow passage R1 in the pressurization chamber R3 and the pressure increasing plunger 4*b* is small and a gap between the opening end (discharge opening) of the discharge flow passage R2 in the pressurization chamber R3 and the pressure increasing plunger 4*b* is wider than the gap between the suction opening and the pressure increasing plunger 4*b*. The enlarged gap portion is set such that a region, which is between the suction flow passage R1 and the discharge flow passage R2 in a circumferential direction of the pressure increasing plunger and has a large distance between the suction flow passage R1 and the discharge flow passage R2, is a region where a gap between the pressure increasing plunger 4*b* and an inner wall of the pressurization chamber R3 is the widest.

The plunger pump 1 of the embodiment is set such that a gap between the pressure increasing plunger 4*b* and the inner circumferential surface of the pressurization chamber R3 in the circumferential direction of the plunger is wide in a region which is separated away from the suction opening and the discharge opening and in which cavitation is most likely to occur. For this reason, a sudden pressure decrease of fuel can be suppressed in a region, which is separated away from the suction opening and the discharge opening in a circumferential direction of the plunger and in which a sudden pressure decrease of fuel is most likely to occur, and thus the occurrence of cavitation can be effectively suppressed. Cavitation can be more effectively suppressed by setting a wide gap on a discharge opening side where cavitation is more likely to occur than the suction opening side.

In addition, in the embodiment, a wide gap (enlarged gap portion) can be formed between the pressurization chamber R3 and the pressure increasing plunger 4*b* instead of providing the recessed portion 2*c*, and thus forming is easy compared to a case where the recessed portion 2*c* is formed in the inner circumferential surface of the pressurization chamber R3.

Fifth Embodiment

A modification example of the plunger pump 1 according to the first embodiment will be described as a fifth embodiment. The same mechanisms will be assigned with the same references, and description thereof will be omitted.

Figure 3E:
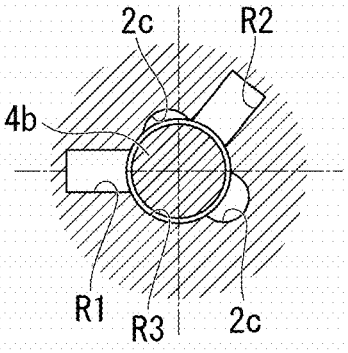
FIG. 3E is a view illustrating a fifth embodiment of the present invention, and is a view of a section perpendicular to a pressure increasing plunger of a plunger pump, which includes a body, a suction mechanism, and a discharging mechanism.

As illustrated in FIG. 3E, the plunger pump 1 according to the embodiment is provided such that the suction flow passage R1 and the discharge flow passage R2 form an angle of 120 degrees. In addition, two recessed portions 2*c* are formed in regions between the suction flow passage R1 and the discharge flow passage R2 in the circumferential direction in the inner circumferential surface of the pressurization chamber R3. One recessed portion 2*c* is provided in a region where a distance between the suction flow passage R1 and the discharge flow passage R2 in the circumferential direction is short. The other recessed portion 2*c* is provided in a region where a distance between the suction flow passage R1 and the discharge flow passage R2 in the circumferential direction is long. The recessed portion 2*c* formed in the region where the distance between the suction flow passage R1 and the discharge flow passage R2 in the circumferential direction is long has a larger volume than the recessed portion 2*c* formed in the region where the distance between the suction flow passage R1 and the discharge flow passage R2 in the circumferential direction is short.

Consequently, at the time of a suction stroke, fuel is caused to remain in the regions between the suction flow passage R1 and the discharge flow passage R2 in the circumferential direction, that is, regions of the pressurization chamber R3, into which fuel is unlikely to flow, and thus it is possible to prevent cavitation.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

Although a configuration where the recessed portions 2*c* are formed at two places opposing each other with the pressure increasing plunger 4*b* interposed therebetween is adopted in the first embodiment, the present invention is not limited to only the configuration. Positions where the recessed portions 2*c* are to be formed are not limited insofar as the recessed portions 2*c* are formed at positions between the suction mechanism 3 and the discharging mechanism 5 in the circumferential direction.

EXPLANATION OF REFERENCES

1: plunger pump
2: body
2*a*: surrounding wall portion
4: pressure increasing mechanism
4*a*: barrel
4*b*: pressure increasing plunger
R3: pressurization chamber
R5: through space

What is claimed is:

1. A plunger pump comprising:

a pressurization chamber that has a tubular inner circumferential wall; and a plunger that has a substantially cylindrical outer circumferential surface and is held by a guide portion so as to freely slide along an extending direction of the inner circumferential wall, wherein the inner circumferential wall has, in a part thereof in a circumferential direction about an axis of the plunger, a suction opening, which communicates with the pressurization chamber and is for introducing a fuel into the pressurization chamber, and wherein the inner circumferential wall is formed with an enlarged gap portion having larger dimension than a dimension, at a position of the suction opening, from the outer circumferential surface of the plunger to an inner circumferential surface of the inner circumferential wall along a radial direction of the plunger, in at least a part of the inner circumferential wall at a position away from the position of the suction opening in the circumferential direction wherein a discharge opening for discharging the fuel from the pressurization chamber is provided in the inner circumferential wall and wherein the enlarged gap portion is provided in a region closer to the discharge opening in the circumferential direction than to the suction opening;

wherein a sectional shape of the inner circumferential wall, which is orthogonal to the axis of the plunger, is a circular shape, and the axis of the plunger is disposed to be eccentric to a center of the circular shape toward a suction opening side; or, an elliptical shape, and the suction opening and the discharge opening are provided in the inner circumferential wall on a minor axis side, and an interval between the inner circumferential wall on a major axis side of the elliptical shape and the outer circumferential surface of the plunger is the enlarged gap portion.

* * * * *